United States Patent [19]

Mues

[11] Patent Number: 4,967,493

[45] Date of Patent: Nov. 6, 1990

[54] FOUL TIP PROTECTOR

[76] Inventor: David Mues, 451 Blossom La., Cincinnati, Ohio 45244

[21] Appl. No.: 350,452

[22] Filed: May 11, 1989

[51] Int. Cl.[5] ..... A43C 13/14; A43B 5/00

[52] U.S. Cl. ..... 36/72 R; 36/126

[58] Field of Search ..... 36/126, 72 R, 77 R, 36/77 M

[56] References Cited

U.S. PATENT DOCUMENTS

| | | | |
|---|---|---|---|
| 1,224,655 | 5/1917 | Lloyd | 36/126 X |
| 2,927,384 | 3/1960 | Duffy | 36/72 R |
| 3,481,055 | 12/1969 | Herman | 36/72 R |
| 3,561,142 | 2/1971 | Streit, Sr. et al. | 36/72 R |
| 3,841,004 | 10/1974 | Gray et al. | 36/72 R |
| 3,995,382 | 12/1976 | Smith | 36/72 R |
| 4,333,248 | 6/1982 | Samuels | 36/72 R |

FOREIGN PATENT DOCUMENTS

| | | | |
|---|---|---|---|
| 1087071 | 8/1954 | France | 36/72 R |

*Primary Examiner*—James Kee Chi

[57] ABSTRACT

A two piece foul tip protector to be worn on the shoe of a baseball player to protect the foot includes a lower toe piece secured to the toe of the shoe, an upper covering piece located above the lower piece and extending rearwardly toward the ankle of the player, and cooperating attachment means protruding from the top surface of the lower piece and the bottom surface of the upper piece to releasably hold the upper piece in a raised position above the bridge of the shoe with a clearance distance therebetween. The clearance distance provides shock absorption upon impact from a baseball, while at the same time permitting freedom of movement for the footr. The upper piece may be detached with the batter has safely reached a base, thereby to facilitate base running.

11 Claims, 2 Drawing Sheets

FOUL TIP PROTECTOR

FIELD OF THE INVENTION

This invention relates to a protective cover attachable to the shoe of a baseball player to protect the foot from foul tipped balls.

BACKGROUND OF THE INVENTION

Perhaps the most difficult skill to master in sport is that of hitting a baseball. From a mere 60 feet 6 inches away, the baseball is hurled toward the plate at speeds of over 90 miles per hour, the ball capable of performing numerous aerodynamic tricks (some within the rules, some not) along the way. In a very brief period of time, the batter must locate the ball, decide whether or not to swing, and then react in time to make contact with the ball. A batter who hits "safely" about 30% of the time is considered highly successful. This does not account for the total number of times that pitches are swung at by the batter, but are either missed or fouled off.

Because of the extreme difficulty in mastering this skill, a baseball player must spend countless hours in batting practice in order to achieve any significant degree of success. The ballplayer must continuously practice to refine or improve the mechanics and timing of the swing. Of a typical baseball player's total time spent batting, the greater part of that time is spent taking batting practice outside of actual game situations.

In order to make the most efficient use of batting practice time, it is important that practice conditions simulate those of an actual game, with the player maintaining a consistently high level of concentration throughout. Because bad habits acquired during batting can be carried over into actual game situations, it is important for a player to block out the distractions and other factors that might impair concentration during batting practice. Over the course of a season that lasts 162 games and extends for a period of over 6 months, this task can prove to be exceedingly difficult to accomplish.

One such factor that can adversely affect the concentration of a ballplayer is that of physical ailments, particularly the nagging minor injuries that inevitably accumulate over the course of the long season. One such injury that occurs regularly to baseball players is that caused by a foul tipped ball striking the foot. While many fans have probably witnessed this occurrence in an actual game, most do not realize the frequency at which foul tipped pitches strike the foot of a batter during a typical season, or the ensuing pain that can adversely affect a hitter's technique thereafter.

While various types of protective devices have been incorporated into or firmly fastened to shoes in order to protect the feet of the wearer, for instance the metal plated toe of a working boot, or a catcher's shin guard that shields the top of the foot, such devices are not practical for a baseball player either during batting practice or in an actual game. Conventional shields or plates of this type would simply be too bulky and would impair the normal foot movement of a batter during the swing, either due to the added weight of the device or the physical restriction of foot movement that results when the device is attached to the shoe. Moreover, a plate of this type attached to a baseball player's shoe could not be worn in an actual game without seriously affecting the player's ability to run the bases. Other attachable shields such as the baseball shoe safety protector disclosed in Herman U.S. Pat. No. 3,481,055 suffer this same disadvantage. That is, the physical restriction to movement renders use of the device in actual game conditions to be simply out of the question.

While it may be possible that such a device could be devised for use in batting practice only, batting practice would then not simulate the hitting conditions of an actual game. Unlike a batting glove, which prevents hand blisters during practice and in actual game conditions in a manner which does not interfere with the batter's swing, the use of a protective plate during batting practice only could result in the ballplayer's acquiring bad habits that adversely affect his performance in actual game conditions.

It is an object of this invention to provide a protective device for the foot of a baseball player that can be worn during batting practice in a manner such that practice conditions do not noticeably differ from those of actual game conditions.

It is another object of this invention to provide a protective device for the foot of a baseball player that can be worn both in batting practice and in actual games, without adversely affecting the ballplayer's ability to run the bases during actual games.

SUMMARY OF THE INVENTION

This invention contemplates the use of a two piece protective device to be worn on the shoe of a baseball player to protect the foot from batted balls. The lower piece is either fixedly or removably secured to the toe of a conventional baseball shoe, and the upper piece is removably held to the first piece in a raised position above the top of the shoe. The spacing between the top of the shoe and the upper piece provides shock absorption when struck by a batted ball and also permits a sufficient degree of freedom of movement for the foot during the baseball swing. The upper piece can be easily detached for base running.

To these ends, according to a preferred embodiment of the invention, a foul tip protector includes a light weight lower toe piece integrally formed on the toe of a conventional baseball shoe and a light weight upper covering piece shaped to extend rearwardly from above the lower piece to cover the top or the bridge of the shoe. Either the top surface of the lower piece or the bottom surface of the upper piece has a pair of spaced channels protruding therefrom toward a corresponding pair of spaced beads protruding from the other of the surfaces. The channels are of inverted T-shaped cross-section to releasably hold corresponding beads of T-shaped cross-section.

Preferably, both pieces are molded out of plastic, and the channels and beads are integrally formed during molding. The plastic composition enables the upper piece to be vertically snapped into place on the lower piece or horizontally slid along the length of the channels in a longitudinal direction along the shoe. Either manner of connection provides the same convenient detachment.

Because the grooves and channels are releasably engaged proximate the toe of the shoe, and the upper piece extends rearwardly toward the ankle but is not connected to the top or the sides of the shoe, some degree of relative movement between the upper piece and the shoe is permitted. This enables the ballplayer to step into the ball naturally during the swing, or to shift weight onto the foot without being restricted by the protector. At the same time, while this clearance distance between the upper piece and the top of the shoe may vary, it continues to serve as a shield to protect the foot from batted balls. To provide maximum protection, the sides of the upper piece are shaped to cover both the instep of the foot and the outside of the foot, with an arcuately receding midportion therebetween that is located above the shoelaces when the upper piece is in place.

Because the pieces are molded from light weight plastic, the weight of a shoe equipped with a protector is not noticeably different from a shoe without the protector. Thus, a batter may choose to wear the protector during batting practice and remove it during actual games without experiencing any noticeable difference. Moreover, because the upper piece is removably held to the lower piece, this protective device can be worn in actual game conditions and removed when running the bases. A player simply detaches the upper piece once he has reached base safely, as is currently done with either the putting on or taking off of a glove by a base runner.

While it is preferable to mold the lower piece integrally with the toe of the shoe, it can also be removably secured by a screw attachment to the forwardmost cleat on the bottom of the shoe. The protector may be worn on either foot or both feet, for either a righthanded or a lefthanded batter.

These and other features of the invention will be more readily appreciated in view of the following detailed description and the drawings in which:

DETAILED DESCRIPTION OF THE DRAWINGS

Figure 1:
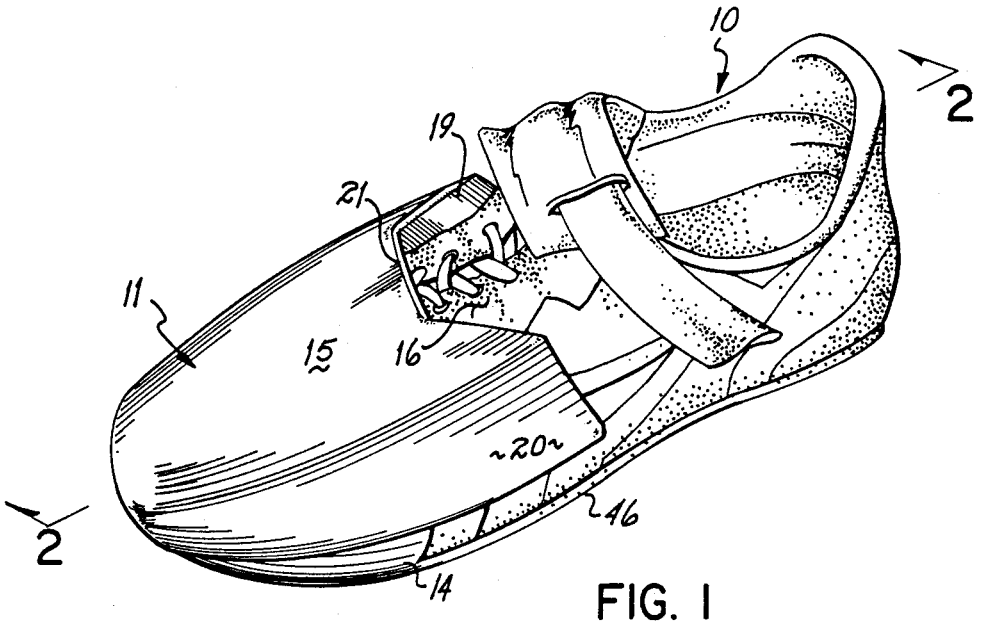
FIG. 1 is a perspective view of a foul tip protector in accordance with a preferred embodiment of the invention.

FIG. 1 shows a baseball shoe or cleat 10 equipped with a foul tip protector 11 in accordance with a preferred embodiment of the invention. Protector 11 includes a lower toe piece 14 (shown in FIGS. 2 and 4) that is integrally formed with the toe of the shoe 10 and an upper piece 15 that is releasably attached to and located above lower piece 14. The upper piece 15 extends rearwardly to cover the top or bridge 16 of the shoe 10. The upper piece 15 is shaped to provide maximum protection and to allow freedom of movement, with sides 19 and 20 extending rearwardly to cover the instep and the outer portion of the shoe 10, respectively, and a midportion 21 that recedes arcuately between the sides and is located above the laces.

Figure 2:
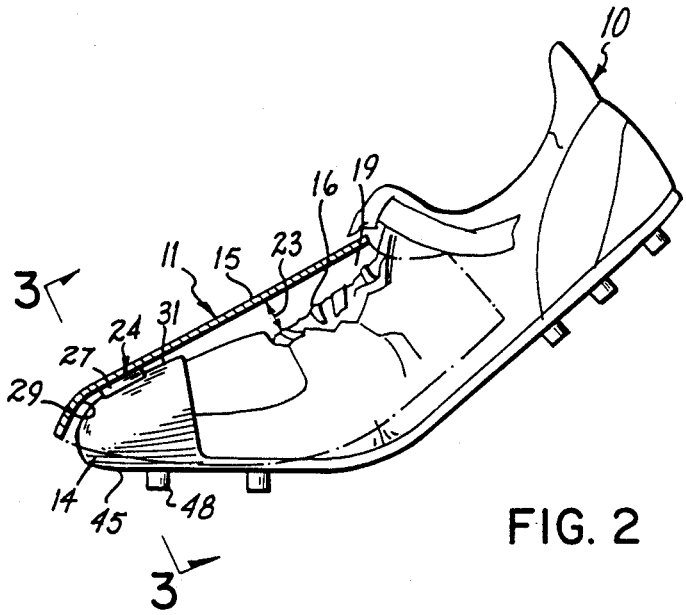
FIG. 2 is a partial cross-sectional view taken along lines 2—2 of FIG. 1.
Figure 4:
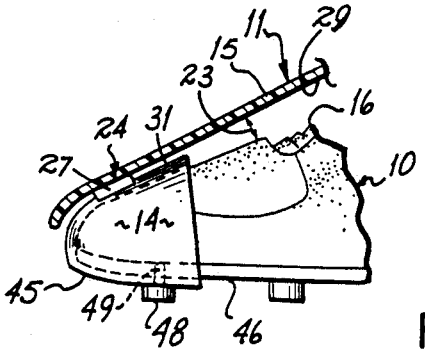
FIG. 4 is a partial cross-sectional view similar to FIG. 2, showing an alternative manner of securing the lower piece to the toe of the shoe.

When attached, the upper piece 15 is releasably held by lower piece 14 in a raised position above the top 16 of the shoe 10 with a clearance distance 23 therebetween, as shown in FIGS. 2 and 4. This clearance distance 23 between the shoe 10 and the upper piece 15 facilitates movement of the ballplayer's foot during hitting while at the same time helping to reduce or attenuate the shock or force caused by an impacting baseball.

Figure 3A:
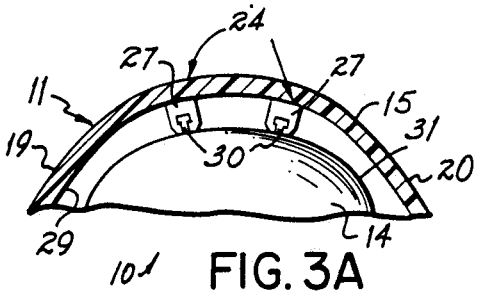
FIG. 3A is a cross-sectional view taken along lines 3—3 of FIG. 2.

According to a preferred embodiment of the invention as shown in FIG. 3A, attaching means 24 for releasably attaching the upper 15 and lower 14 pieces includes a pair of spaced channels 27 that protrude downwardly from a bottom surface 29 of upper piece 15. The channels 27 extend longitudinally of the shoe 10. A corresponding pair of spaced beads 30 protrude upwardly from a top surface 31 of lower piece 14 for releasable engagement with the channels 27. The beads 30 also extend longitudinally of the shoe 10. This releasable engagement provides the clearance distance 23 between the upper 15 and lower 14 pieces and between upper piece 15 and the top 16 of the shoe 10. Preferably, the channels 27 are of inverted T-shape in cross section and sized to receive beads 30 that are of T-shaped cross section.

Although not critical to the invention, the beads 30 and channels 27 extend about an inch and a half along the length of the shoe 10 and are formed integrally with the upper 15 and lower 14 pieces by molding. It is also to be understood that, alternatively, the channels 27 could protrude upwardly from lower piece 14 and the beads 30 protrude downwardly from the upper piece 15. Engagement between the beads 30 and the channels 27 can be accomplished by either vertically snapping the beads 30 into the channels 27 directly, or by horizontally sliding the beads 30 into position along the length of the channels 27. Either way, the upper 15 and lower 14 pieces are held together in a releasable manner to provide the clearance distance 23 between upper piece 15 and top 16 of the shoe 10.

Figure 3B:
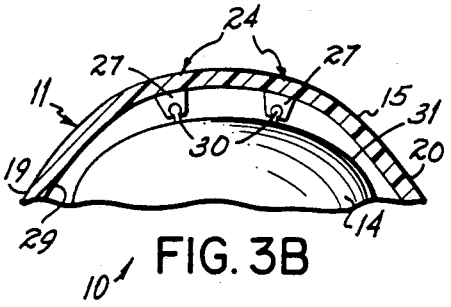
FIG. 3B is a cross-sectional view similar to FIG. 3A, showing an alternate embodiment of the attaching means of the invention.
Figure 3C:
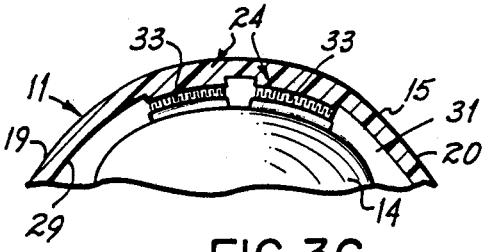
FIG. 3C is a cross-sectional view similar to FIG. 3A, showing yet another embodiment of the attaching means of the invention.

Other forms of attachment means 24 could also be utilized without departing from the scope of the invention, as shown in FIGS. 3B and 3C. In FIG. 3B, the channels 27 and beads 30 are of tear-shaped cross section, or rounded off T-shapes. In FIG. 3C, Velcro fasteners 33 are mounted upon protrusions that extend outwardly from the top 31 and bottom 29 surfaces of the lower 14 and upper 15 pieces, respectively.

If desired, the lower piece 14 can be formed integrally with the toe of the shoe 10. This can be done during manufacture of the shoe 10 by forming a raised hardened plastic portion at the toe to serve as lower piece 14, and subsequently adhering, or mechanically securing the attachment means 24 to the top surface 31. If Velcro is used, the backside could be adhesively secured to top surfaces 31. For attaching the beads 30, a bottom surface of the beads 30 could be heat sealed or fused to top surface 31. Alternately, the lower piece 14 and its corresponding portion of the attachment means 24 could be molded as one piece and then the entire lower piece 14 adhesively secured or sewn or stitched to the toe of the shoe 10.

Figure 5:
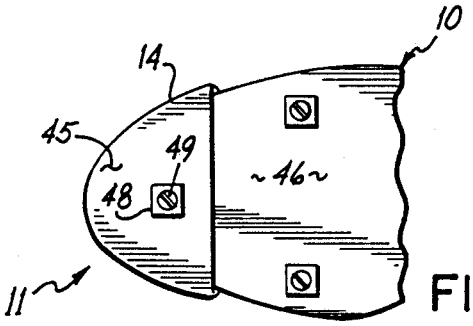
FIG. 5 is a bottom view of the embodiment shown in FIG. 4.

It would also be possible to form lower piece 14 (with or without the attachment means 24 integrally formed therewith) as a separate toe cup that is removably secured to the shoe 10, as shown in FIGS. 4 and 5. According to this embodiment, the lower piece 14 fits over the toe of the shoe 10, with a bottom section 45 shaped to reside beneath the under surface 46 of the toe of the shoe 10. Bottom section 45 has a hole aligned with the position of forwardmost spike 48 of the shoe 10. By removing this spike 48, fitting the toe cup 14 over the toe and aligning the hole with the spike hole, a screw 49 can be tightened upon both the spike 48 and the lower piece 14 for securement to the shoe 10.

While a preferred embodiment of the invention has been described, applicant does not wish to be limited thereby, and it is to be understood that various modifications could be made without departing from the spirit of the invention. Accordingly, it is to be understood that changes may be made without departing from the scope of the invention as particularly set out and claimed.

I claim:

1. A foul tip protector to be worn on the shoe of a baseball player to protect the foot comprising:

a lower toe piece secured to a toe portion of the shoe, the lower piece having a top surface;

an upper covering piece disposed above the lower piece and extending rearwardly thereof and over a bridge portion of the shoe, the upper piece having a bottom surface; and attachment means associated with said toe piece top surface and said covering piece bottom surface to releasably hold the covering piece to the toe piece in a raised position above the bridge of the shoe with a clearance distance therebetween, thereby to provide shock absorption under the impact of a batted ball and freedom of movement for the foot during hitting.

2. The foul tip protector of claim 1 wherein the lower toe piece is formed integrally with the shoe.

3. The foul tip protector of claim 1 wherein the lower toe piece is removably secured to the shoe.

4. The foul tip protector of claim 1 wherein said upper covering piece is made of light weight plastic.

5. The foul tip protector of claim 3 wherein the lower toe piece and the upper covering piece are both made of light weight plastic.

6. The foul tip protector of claim 1 wherein the attachment means further comprises:

a pair of spaced channels formed on one of said surfaces and protruding toward the other of said surfaces, the channels extending along the length of the shoe and the channels having an inverted T-shaped cross-section; and a pair of spaced beads protruding from the other of said surfaces and being sized and shaped to be releasably engaged by the channels in order to hold the upper piece above the bridge of the shoe.

7. The foul tip protector of claim 1 wherein the upper covering piece has sides that extend rearwardly from the toe to cove both the instep of the foot and the outside of the foot, the covering piece also having an arcuately receding midportion between said sides.

8. A foul tip protector to be worn on the shoe of a baseball player to protect the foot comprising:

a lower toe piece integrally formed with the toe portion of the shoe, the lower piece having a top surface;

an upper covering piece disposed above the lower piece and extending rearwardly thereof over a bridge of the shoe, the upper piece having a bottom surface;

a pair of spaced, longitudinally extending channels of inverted T-shaped cross-section protruding from one of said top and bottom surfaces; and a pair of spaced, longitudinally extending beads of T-shaped cross-section protruding from the other of said surfaces and adapted to releasably engage the channels to hold the covering piece in a raised position above the bridge of the shoe with a clearance distance therebetween, thereby to provide shock absorption under the impact of a batted ball and freedom of movement for the foot during hitting.

9. The foul tip protector of claim 8 wherein both the channels and the beads are integrally formed with the respective surfaces.

10. A foul tip protector to be worn on the shoe of a baseball player to protect the foot comprising:

a lower toe piece removably received to the toe portion of the shoe, the lower piece having a top surface;

an upper covering piece disposed above the lower piece and extending rearwardly thereof over a bridge of the shoe, the upper piece having a bottom surface;

a pair of spaced, longitudinally extending channels of inverted T-shaped cross-section protruding from one of said top and bottom surfaces; and a pair of spaced, longitudinally extending beads of T-shaped cross-section protruding from the other of said surfaces and adapted to releasably engage the channels to hold the covering piece in a raised position above the bridge of the shoe with a clearance distance therebetween, thereby to provide shock absorption under the impact of a batted ball and freedom of movement for the foot during hitting.

11. The foul tip protector of claim 10 wherein both the channels and the beads are integrally formed with the respective surfaces.

* * * * *